United States Patent [19]

Yoshida et al.

[11] Patent Number: 5,076,168

[45] Date of Patent: Dec. 31, 1991

[54] SHIELDING SHEET FOR BLASTING OPERATION

[75] Inventors: Ichiro Yoshida, Osaka; Yutaka Aiga, Tachikawa, both of Japan

[73] Assignee: Toyo Boseki Kabushiki Kaisha, Osaka, Japan

[21] Appl. No.: 480,565

[22] Filed: Feb. 15, 1990

[30] Foreign Application Priority Data

Feb. 16, 1989 [JP] Japan ..... 1-37415

[51] Int. Cl.[5] ..... F42D 5/00

[52] U.S. Cl. ..... 102/303

[58] Field of Search ..... 102/303

[56] References Cited

U.S. PATENT DOCUMENTS

| | | | |
|---|---|---|---|
| 3,648,613 | 3/1972 | Cunn | 102/303 |
| 3,801,416 | 4/1974 | Gulbierz | 102/303 |
| 4,643,119 | 2/1987 | Langston et al. | 102/303 X |

*Primary Examiner*—Peter A. Nelson

*Attorney, Agent, or Firm*—Wegner, Cantor, Mueller & Player

[57] ABSTRACT

A shielding sheet for blasting operations which comprises a fabric for shielding a site to be destructed by a blasting operation, said fabric composed of a yarn of polyethylene fiber having a tensile strength of not less than 15 g/d, a tensile modulus of not less than 400 g/d and a total denier of not less than 600, and a weight of said fabric being not less than 130 g/m$^2$.

14 Claims, 3 Drawing Sheets

SHIELDING SHEET FOR BLASTING OPERATION

FIELD OF THE INVENTION

The present invention relates to a shielding sheet for blasting operations which is used for shielding a site to be blasted to prevent blown stones, scattering of dust and propagation of noises caused by blasting, when blasting operations are carried out for excavation of tunnels, construction of roads, destruction of concrete buildings and the like.

BACKGROUND OF THE INVENTION

When tunnels are constructed, in order to prevent scattering of crushed stones and dust, iron plates or used mats are set up at a certain distance from working faces, or nylon woven fabric is suspended like a curtain.

However, when iron plates or used mats are set up, their handling is troublesome because they are heavy. When a nylon woven fabric is suspended, although the woven fabric is lightweight and is readily handled, it is destroyed by several times of blasting operations because of its low strength and becomes unusable.

As a sheet to be used for this purpose, Japanese Patent Kokai No. 62-284900 discloses an explosion-proof sheet for excavation tunnels which comprises an external air bag and an internal sheet of high tenacity fibers such as aramid fibers. Japanese Patent Kokai No. 63-80198 discloses a material having high-impact properties such as that used for helmets, bulletproof jackets and the like which comprises a fabric of polyolefin multifilaments having high strength and high modulus.

OBJECTS OF THE INVENTION

One object of the present invention is to provide a shield sheet for blasting operations which can prevents scattering of crushed stones and dust and reduces propagation of noises, when blasting operations are carried out for excavation of tunnels, construction of roads, destruction of concrete buildings and the like.

Another object of the present invention is to provide a shielding sheet for blasting operations which is lightweight and easily handled like a conventional nylon woven fabric and, at the same time, it has excellent durability in comparison with the conventional nylon woven fabric.

These objects as well as other objects and advantages of the present invention will become apparent to those skilled in the art from the following description with reference to the accompanying drawings.

SUMMARY OF THE INVENTION

Figure 1:
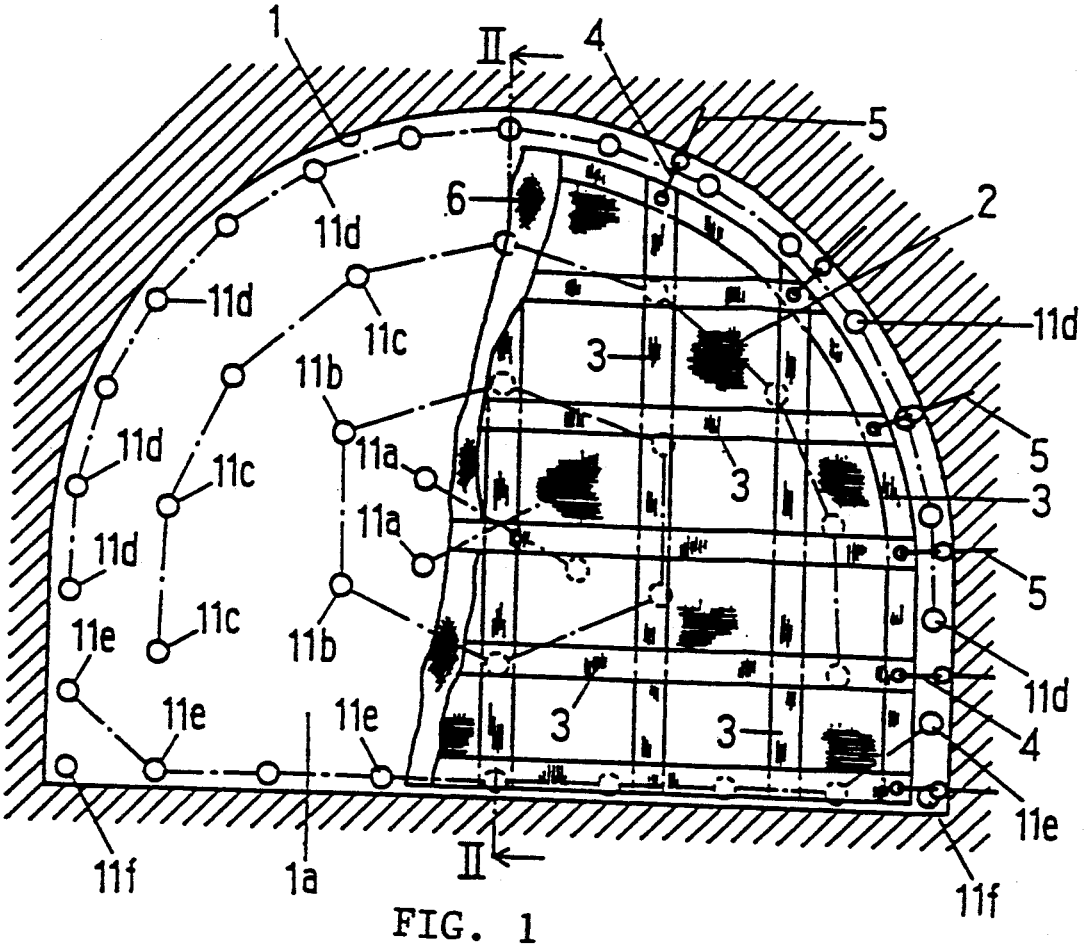
FIG. 1 is a schematic cross section of a tunnel.

According to the present invention, there is provided a shielding sheet for blasting operations which comprises a fabric for shielding a site to be destructed by a blasting operation, said fabric composed of a yarn of polyethylene fiber having a tensile strength of not less than 15 g/d, a tensile modulus of not less than 400 g/d and a total denier of not less than 600, and a weight of said fabric being not less than 130 g/m$^2$.

DETAILED EXPLANATION OF THE INVENTION

The polyethylene fiber to be used for the fabric of the present invention has a tensile strength of not less than 15 g/d, preferably not less than 20g/d, and a tensile modulus of not less than 400 g/d, preferably not less than 600 g/d. The fiber is produced by spinning an ultra high molecular weight polyethylene having a viscosity-average molecular weight of not less than 500,000, preferably not less than 600,000. The fabric of the present invention is woven by using the above polyethylene fiber as both weft and warp, and the size and density of the weft and warp are chosen so that a weight of the fabric becomes not less than 130 g/m$^2$, preferably 200 to 300 g/m$^2$. It is preferred that the above weft and warp are multifilament yarn having a size of not less than 300 d. Preferably, the density of the weft and warp is not more than 80 yarns per inch, particularly, 50 to 70 yarns per inch. The total denier of the fiber is not less than 600, preferably, 700 to 1,000.

The fabric of the present invention can be used by laminated with a cloth composed of another fiber such as a mesh sheet of polyvinyl chloride or polyvinylidene chloride, or coating a synthetic resin such as polyvinyl chloride or polyvinylidene chloride on one or both surfaces thereof. Further, it can be used by perforating a large number of air holes and it is preferred that such air holes are perforated in a diameter of 20 to 30 mm at intervals of 30 to 40 cm so that the total area of the holes becomes about 2 to 10%, preferably, 5% of the whole area of the sheet.

For example, the shielding sheet for blasting operations of the present invention is used, in the case of excavation of a tunnel, by spreading it in front of a working face. In the case of open-pit mining such as construction of a road, it is used by spreading it along the surface of the earth. In the case of destruction of a concrete building, it is used by spreading it to surround the circumference of the building. Since the shielding sheet of the present invention is woven by the polyethylene fiber having the high tensile strength and the high modulus, it is scarcely damaged by a blast or scattering crushed stones.

The following Examples and Comparative Examples further illustrate the present invention in detail but are not to be construed to limit the scope thereof.

EXAMPLES 1 TO 4 AND COMPARATIVE EXAMPLES 1 TO 5

By using an ultra high molecular weight polyethylene fiber having viscosity-average molecular weight of 700,000 and a high tenacity nylon fiber, nine kinds of woven fabrics of Examples 1 to 4 and Comparative Examples 1 to 5 as shown in Table 1 were produced.

In Table 1, "PE" and "NY" of the raw materials mean polyethylene and nylon, respectively. The "mesh" of the reinforced layer of Example 3 means that a polyvinylidene chloride mesh is laminated on one surface of the woven fabric and "coating" of the reinforced layer of Example 3 means that polyvinyl chloride is coated on both surfaces of the woven fabric.

TABLE 1

| | Example No | | | | Comparative Example No. | | | | |
|---|---|---|---|---|---|---|---|---|---|
| | 1 | 2 | 3 | 4 | 1 | 2 | 3 | 4 | 5 |
| Properties of raw fiber | | | | | | | | | |
| Raw material | PE | PE | PE | PE | PE | PE | PE | NY | aramid |
| Fineness (denier) | 300 | 800 | 800 | 800 | 800 | 800 | 150 | 3360 | 1000 |
| Tensile strength (g/d) | 32 | 32 | 32 | 32 | 14 | 20 | 35 | 10 | 22 |
| Tensile modulus (g/d) | 1100 | 1000 | 1000 | 1000 | 410 | 390 | 1200 | 90 | 550 |
| Specific gravity | 0.98 | 0.98 | 0.98 | 0.98 | 0.98 | 0.98 | 0.98 | 1.14 | 1.44 |
| Properties of woven fabric | | | | | | | | | |
| Fabric texture | plain weave | plain weave | plain weave | plain weave | plain weave | plain weave | plain weave | plain weave | plain weave |
| Weft density (yarns/inch) | 50 | 33 | 33 | 33 | 33 | 33 | 75 | 15 | 32 |
| Warp density (yarns/inch) | 50 | 33 | 33 | 33 | 33 | 33 | 75 | 15 | 32 |
| Weight (g/m$^2$) | 150 | 260 | 260 | 260 | 260 | 260 | 100 | 480 | 310 |
| Reinforced layer | | | | | | | | | |
| Material | — | — | mesh | coating | — | — | — | — | — |
| Weight (g/m$^2$) | — | — | 450 | 250 | — | — | — | — | — |

Figure 2:
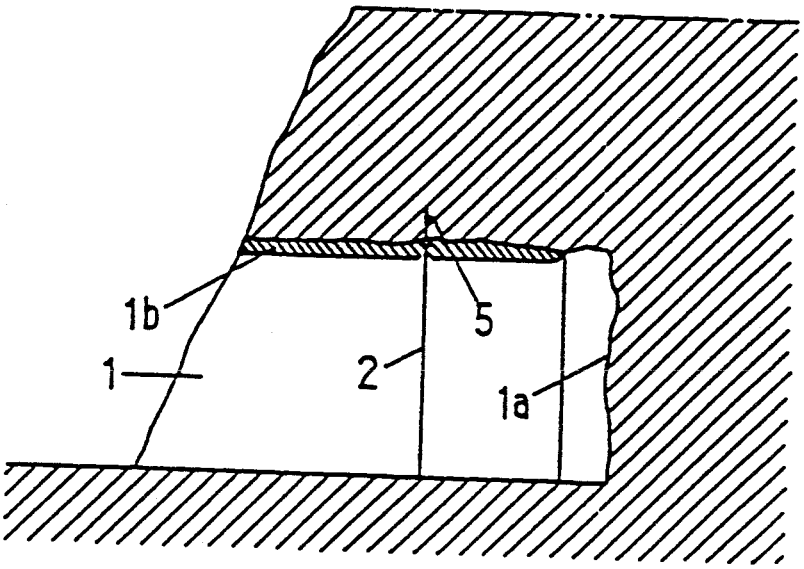
FIG. 2 is a schematic cross section taken along the line II—II of FIG. 1.

By using each of the above nine kinds of fabrics, a shielding sheet 2 for a tunnel 1 having a sectional area of 19.7 m$^2$ shown in FIGS. 1 and 2 was produced. Namely, several sheets of each fabric were seamed together to form a general half-round shielding sheet 2 extending along an inner wall of the tunnel 1 and reinforcing nylon sling belts 3 of 5 cm in width were fixed to the shielding sheet circumferentially, vertically and horizontally and mounting nylon sling belts 4 were then inserted through eyelets fixed to the circumferential reinforcing nylon sling belts 3. Then the sling belts 4 were connected to locking bolts 5 driven at a position of 8 m away from a working face 1*a* of the tunnel 1. Regarding Example 3, a mesh 6 was laminated on the back surface of the shielding sheet 2 and the resulting sheet was spread so that the surface on which the mesh 6 was laminated was faced to the working face 1*a*.

In FIG. 2, the symbol 1*b* is a concrete layer which has been sprayed on a wall surface extending from the entrance of the tunnel 1 to the position of 1.5 m short of the working face 1*a*.

Then, according to the blasting pattern as shown in FIG. 1, a large number of holes 11*a*, 11*b*, 11*c*, 11*d*, 11*e* and 11*f* were perforated on the working face 1*a*. Namely, four holes 11*a* of the 1st row were perforated in the central part, six holes 11*lb* of the 2nd row were perforated along the hexagonal circumferential of the holes of 1st row, nine holes 11*c* of the 3rd row were perforated along the upper circular arc. Fifteen holes 11*d* of the 4th row were perforated along the outside circular arc thereof, nine holes 11*e* of the 5th row were perforated along the lower floor and two holes 11*f* of the 6th row were perforated at the lower corner. Then, blasting explosive and detonators were set therein. Excavation conditions are shown in Table 2 and charging conditions of the blasting explosive are shown in Table 3, respectively.

TABLE 2

| | |
|---|---|
| Sectional area of excavation | 19.7 m$^2$ |
| Blasting progress | 1.0 m |
| Amount of rock excavated | 20 m$^3$ |
| Boring diameter | 42.0 mm |
| Boring length | 1.1 m |
| Blasting explosive | No. 2 Enoki Kayamaito |
| Detonator | Flash electric detonator, or DS delay blasting detonator |
| Blasting explosive unit | 0.77 kg/m$^3$ |

TABLE 3

| Hole | Number of boring | Kind of detonator | Charged amount of blasting explosive (kg) per one hole | per one row |
|---|---|---|---|---|
| 1st row (11a) | 4 | Flash | 0.4 | 1.6 |
| 2nd row (11b) | 6 | DS | 0.3 | 1.8 |
| 3rd row (11c) | 9 | DS | 0.3 | 2.7 |
| 4th row (11d) | 15 | DS | 0.3 | 4.5 |
| 5th row (11e) | 9 | DS | 0.4 | 3.6 |
| 6th row (11f) | 2 | DS | 0.5 | 1.0 |
| total | 45 | — | — | 15.2 |

According to the above conditions, blasting was carried out and, after completion of blasting, the state of damage by blown stones was observed. The results are shown in Table 4. In Table 4, the term "5th time perforated holes" means the number of perforated holes caused by blown stones up to the end of 5th time experiment. The term "perforated holes when scrapped" means the number of perforated holes when the fabric was scrapped. In this experiment, it was decided to scrap the fabric, when a hole of 2 cm or more in diameter was perforated by blown stones. The term "useful time" means the number of times used until the fabric was scrapped.

TABLE 4

| | Example No. | | | | Comparative Example No. | | | | |
|---|---|---|---|---|---|---|---|---|---|
| | 1 | 2 | 3 | 4 | 1 | 2 | 3 | 4 | 5 |
| 5the time perforated holes (holes/19 m$^2$) | 0 | 0 | 0 | 0 | 12 | 8 | 13 | 20 | 0 |
| Perforated holes when scrapped (holes/19 m$^2$) | 8 | 7 | 6 | 8 | 20 | 18 | 25 | 20 | 15 |
| Useful time | 30 | 50 | 70 | 55 | 7 | 10 | 4 | 5 | 15 |

As is clear from Tables 1 and 4, each shielding sheet of Examples 1 to 4 has good durability in comparison with those of Comparative Examples 1 to 5, and almost all of blown stones can be prevented from scattering. Particularly, in the case of Example 3 wherein the mesh sheet made of polyvinylidene chloride was laminated on one surface of the woven fabric of Example 2 and the surface on which the mesh sheet has been laminated was faced to the working face la, i.e., the blowing direction of stones, and Example 4 wherein the both surfaces of the woven fabric of Example 2 were coated with polyvinyl chloride, the mesh sheet or the coating layer thereof weakened impact of blown stones and, therefore, the durability was remarkably improved in comparison with the fabric of Example 2 itself.

To the contrary, in the cases of Comparative Example 1 wherein the tensile strength of the starting fiber used was low, Comparative Example 2 wherein the tensile modulus of the starting fiber used was low, Comparative Example 3 wherein the starting fiber was fine and the weight was small and Comparative Example 4 wherein nylon filament was used, the shielding sheets had low durability and their useful times were not more than one third of that of Example 1. In the case of Comparative Example 5, the shielding sheet had good blown stone-preventing properties up to the 5th times. However, it had poor durability (useful time) because deterioration of properties due to ultraviolet light was large (low light resistance) upon using it in the site.

Figure 3:
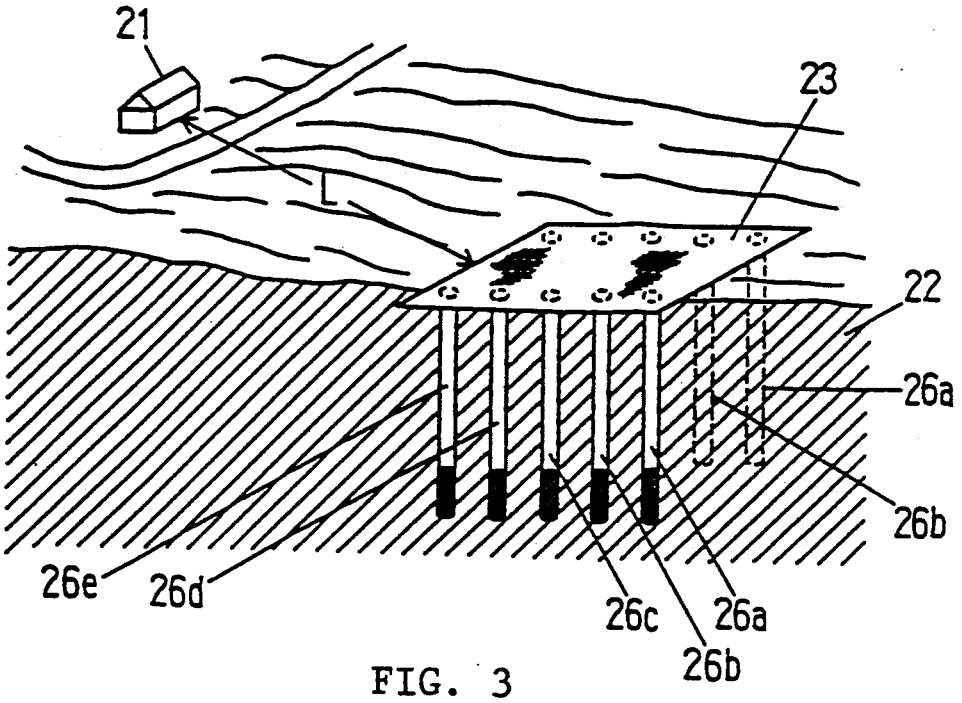
FIG. 3 is a perspective view illustrating surface blasting.
Figure 4:
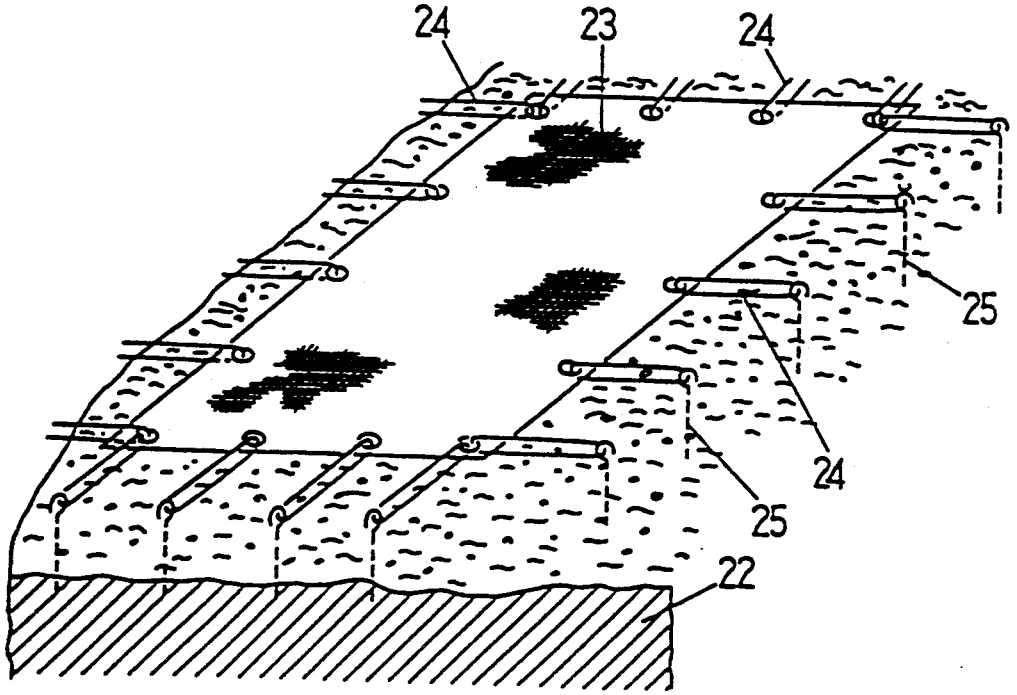
FIG. 4 is an enlarged view of the main part of FIG. 3.

As shown in FIGS. 3 and 4, the shielding sheet 23 of Example 3 was spread on a bedrock 22 where the distance L from a house 21 was 60 m. Namely, the shielding sheet 23 was formed in a rectangle of 4 m in width and 5 m in length and eyelets were fixed on 12 sites of the circumferential part thereof (see FIG. 3) and ropes 24 of 1 m in length inserted through the eyelets were then connected to the locking bolts 25 driven into the bedrock 22. On the other hand, holes 26*a*, 26*b*, 26*c*, 26*d* and 26*e* of 65 mm in diameter were bored on the bedrock 22 under the shielding sheet 23 in two lines and five rows so that the holes were covered with the shielding sheet 23. By using No. 2 Keyaki Kayamaito as the blasting explosive and using a DS delay blasting detonator as the detonator, blasting was carried out under the conditions that the charged amount of blasting explosive per one hole was 3.85 kg and the total charged amount of blasting explosive was 38.5 kg. As a result, blown stones were completely prevented and no damage of the house 21 and construction equipments was caused.

Figure 5:
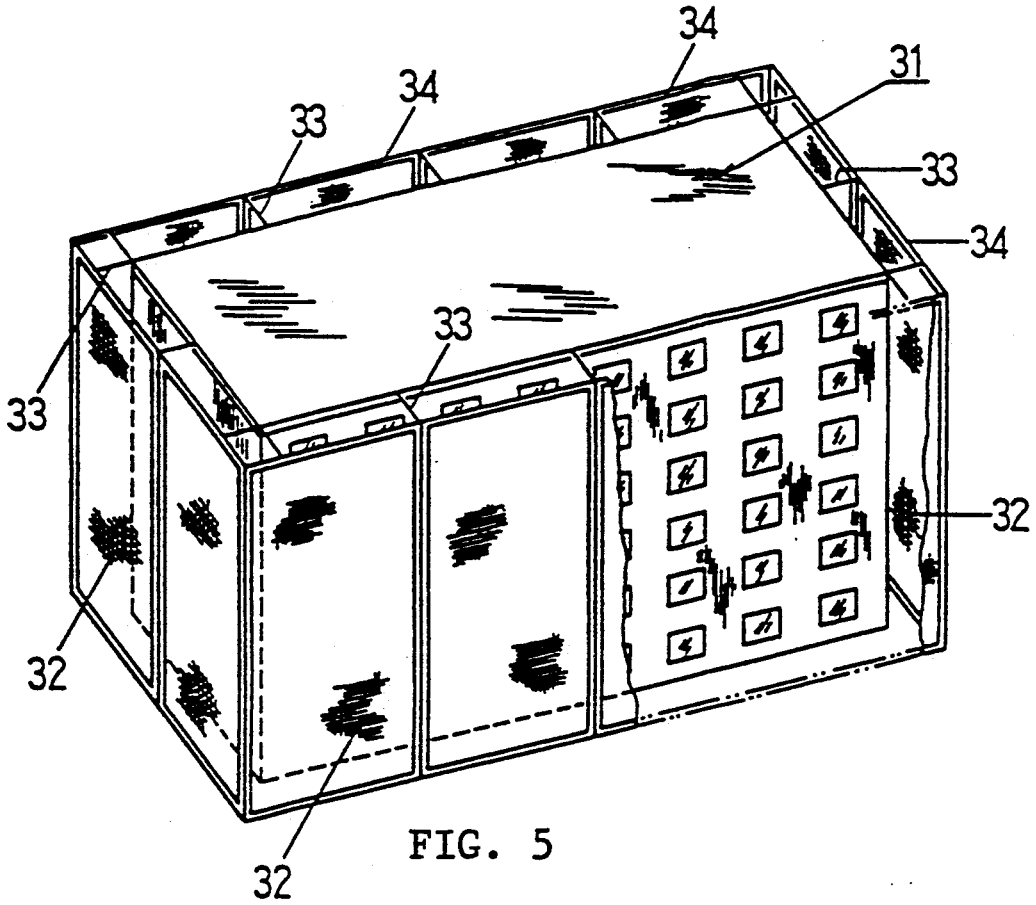
FIG. 5 is a perspective view illustrating blasting of a building.

As shown in FIG. 5, upon blasting a six-storied reinforced concrete building 31 (length: 38 m, width: 9 m and height: 18 m), the total circumference of the building 31 was surrounded with the shielding sheet 32 of Example 3. Namely, arms 33 of 2 m in length were provided protrusively on the outer periphery of the building 31, beams 34 were provided at the apexes of the arms 33, a large number of the shielding sheets 32 were hung down from the beams 34, the neighboring shielding sheets were connected together by inserting nylon ropes through eyelets fixed to the edges of the sheets and then blasting was carried out to destroy the building 31. As a result, blown stones were perfectly prevented and no damage of a neighboring building which was 20 m away from the building 31 was caused.

Since the shielding sheet for blasting operations of the present invention is made of the strong woven fabric, when the sheet is provided in a tunnel, blown stones and dust caused by blasting operations are sealed in the vicinity of working faces to prevent scattering thereof. Further, when surface blasting is carried out, by spreading the shielding sheet of the present invention so that the earth surface of a site to be blasted is covered, blown stones and dust can be sealed under the sheet to prevent scattering thereof. Furthermore, when a building is destroyed by blasting, by surrounding the building with the shielding sheet of the present invention, blown stones and scattering of dust can be prevented. In any cases, by preventing blown stones, stones and dust can be readily collected and the time required for collecting them can be reduced. At the same time, a refuge distance of heavy engineering rolling stocks, lighting equipments and the like are shortened to reduce a working cycle time and noises can be reduced. In addition, since the shielding sheet of the present invention is mainly composed of the woven fabric made of polyethylene fiber having high strength and high modulus, it is lightweight in comparison with a conventional mat or iron plate and easily handled. At the same time, it has excellent durability in comparison with a conventional nylon woven fabric and the lifetime is prolonged by not less than three times as that of the nylon woven fabric.

What is claimed is:

1. In a blasting operation having a shielding sheet to shield a site to be destructed by a blasting operation, the improvement which comprises construction of the fabric for said shielding sheet composed of a yarn of polyethylene fiber having a tensile strength of not less than 15 g/d, a tensile modulus of not less than 400 g/d and a total denier of not less than 600, and a weight of said fabric being not less than 130 g/m$^2$.

2. The improvement according to claim 1, wherein the total denier of polyethylene fiber is 700 to 1,000.

3. The improvement according to claim 1, wherein the fabric has a texture of plain weave.

4. The improvement according to claim 1, wherein a mesh sheet is laminated on at least one surface of the fabric.

5. The improvement according to claim 4, wherein the mesh sheet is composed on polyvinyl chloride or polyvinylidene chloride.

6. The improvement according to claim 1, wherein at least one surface of the fabric is coated with a resin.

7. The improvement according to claim 6, wherein the resin is polyvinyl chloride or polyvinylidene chloride.

8. The improvement according to claim 1, wherein air holes in a diameter of 20 to 30 mm are perforated through the sheet at intervals of 30 to 40 cm so that the total area of the holes becomes about 2 to 10% of the whole area of the sheet.

9. The improvement according to claim 1, wherein the weft and warp of the fabric are composed of the polyethylene fiber.

10. The improvement according to claim 1, wherein the tensile strength of the polyethylene fiber is not less than 20 g/d.

11. The improvement according to claim 1, wherein the tensile modulus of the polyethylene fiber is not less than 600 g/d.

12. The improvement according to claim 1, wherein a viscosity-average molecular weight of the polyethylene fiber is not less than 500,000.

13. The improvement according to claim 1, wherein the density of the weft and warp is not more than 80 yarns per inch.

14. The improvement according to claim 1, wherein the density of the weft and warp is 50 to 70 yarns per inch.

* * * * *